US007150369B1

(12) United States Patent
Fryar

(10) Patent No.: US 7,150,369 B1
(45) Date of Patent: Dec. 19, 2006

(54) DUAL CHAMBER INFANT BOTTLE

(76) Inventor: Kimberly C. Fryar, 1803 Sapphire Cove, Cedar Park, TX (US) 78613

( * ) Notice: Subject to any disclaimer, the term of this patent is extended or adjusted under 35 U.S.C. 154(b) by 67 days.

(21) Appl. No.: 10/805,541

(22) Filed: Mar. 20, 2004

Related U.S. Application Data

(60) Provisional application No. 60/456,308, filed on Mar. 20, 2003.

(51) Int. Cl.
*A61J 9/00* (2006.01)
*B65D 23/04* (2006.01)

(52) U.S. Cl. ..... 215/11.4; 215/6; 215/10; 215/11.1; 222/134

(58) Field of Classification Search ..... 215/6, 215/10, 11.1, DIG. 8, 11.4, 11.5; 220/502; 222/42, 134, 144.5
See application file for complete search history.

(56) References Cited

U.S. PATENT DOCUMENTS

| | | | | | |
|---|---|---|---|---|---|
| 856,064 | A | * | 6/1907 | Jackson | 222/142.5 |
| 990,662 | A | * | 4/1911 | MacGlashan | 215/11.4 |
| 1,098,653 | A | * | 6/1914 | Whisenant | 215/386 |
| 1,364,763 | A | * | 1/1921 | Houghton | 210/261 |
| 2,372,281 | A | * | 3/1945 | Jordan | 215/11.5 |
| 2,745,568 | A | * | 5/1956 | Newton | 215/11.4 |
| 3,211,315 | A | * | 10/1965 | Griesinger | 215/11.1 |
| 4,141,461 | A | * | 2/1979 | LaChance | 220/253 |
| 4,603,784 | A | | 8/1986 | Chang | 215/11.1 |
| 4,779,722 | A | * | 10/1988 | Hall | 206/221 |
| 4,856,995 | A | | 8/1989 | Wagner | 215/11.1 X |
| 4,893,729 | A | | 1/1990 | Iggulden et al. | 222/42 |
| 4,994,076 | A | * | 2/1991 | Guss | 606/236 |
| 5,060,811 | A | * | 10/1991 | Fox | 215/6 |
| 5,123,574 | A | * | 6/1992 | Poulos | 222/362 |
| 5,150,800 | A | * | 9/1992 | Sarter et al. | 215/11.4 |
| 5,211,300 | A | * | 5/1993 | Hsing et al. | 215/11.4 |
| 5,275,298 | A | * | 1/1994 | Holley et al. | 215/11.4 |
| 5,353,964 | A | | 10/1994 | Liu et al. | 215/11.4 X |
| 5,419,445 | A | * | 5/1995 | Kaesemeyer | 215/11.1 |
| 5,433,328 | A | * | 7/1995 | Baron et al. | 215/11.4 |
| 5,522,516 | A | * | 6/1996 | Duggal et al. | 215/11.4 |
| 5,638,968 | A | * | 6/1997 | Baron et al. | 215/11.4 |
| 5,647,481 | A | * | 7/1997 | Hundertmark et al. | 206/219 |
| 5,678,709 | A | * | 10/1997 | Holley et al. | 215/11.4 |
| 5,704,505 | A | * | 1/1998 | Singh | 215/397 |
| 5,791,503 | A | * | 8/1998 | Lyons | 215/11.5 |
| 6,116,439 | A | * | 9/2000 | Yaniv | 215/11.1 |
| 6,237,800 | B1 | | 5/2001 | Barrett | 215/6 X |
| 2003/0205548 | A1 | * | 11/2003 | Seckler | 215/11.1 |

FOREIGN PATENT DOCUMENTS

| | | | |
|---|---|---|---|
| GB | 2067416 | A * | 7/1981 |

* cited by examiner

*Primary Examiner*—Sue A. Weaver
(74) *Attorney, Agent, or Firm*—Kenneth L Tolar

(57) ABSTRACT

A dual chamber infant bottle for minimizing contamination of an entire batch of baby formula or milk includes an upper feeding reservoir with a conventional baby bottle nipple coupled to the top end thereof. The lower end of the feeding reservoir includes a base portion having an opening therethrough for receiving fluid from a storage reservoir. A valve assembly is removably disposed between the storage reservoir and feeding reservoir for allowing selective flow therebetween.

5 Claims, 2 Drawing Sheets

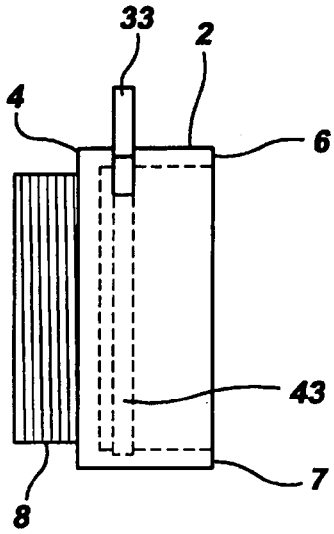
FIG.5
FIG.6
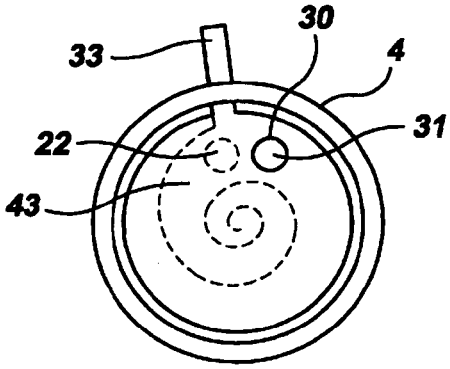
FIG.7
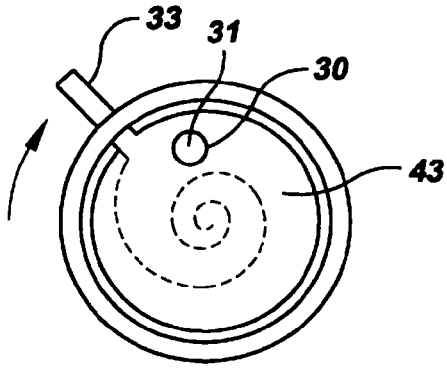
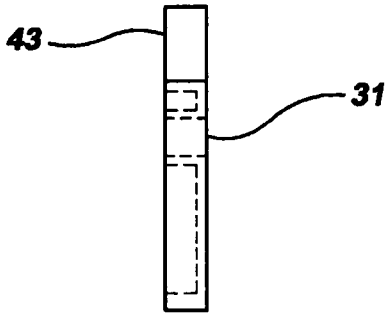
FIG.8

DUAL CHAMBER INFANT BOTTLE

CROSS REFERENCE TO RELATED APPLICATIONS

According to 35 U.S.C § 119(e), this application is entitled to the benefit of provisional application No. 60/456,308 filed on Mar. 20, 2003.

BACKGROUND OF THE INVENTION

1. Technical Field of the Invention

The present invention relates to a dual chamber infant bottle that segregates fresh milk from contaminated milk.

2. Description of the Prior Art

An infant typically consumes milk, breast milk or formula from a conventional baby bottle. However, the infant rarely consumes all of the formula or milk in the bottle. Accordingly, any remaining formula is contaminated with saliva. For health reasons, however, it is generally recommended that any formula or breast milk that has been mixed with saliva be discarded. Accordingly, the use of conventional baby bottles results in significant waste of breast milk or expensive infant formula.

A myriad of infant bottle designs exist in the prior art. For example, U.S. Pat. No. 4,603,784 issued to Chang discloses a nursing bottle system including a pair of axially joined, segregated containers. Each container includes a dispensing opening to which a nipple can be attached to feed an infant from a select one of the containers. The design allows two separate fluids to be selectively dispensed from a single bottle.

U.S. Pat. No. 4,856,995 issued to Wagner discloses a nursing bottle including a pair of reservoirs which are in selective communication with a single nipple. The nipple includes a housing having a dispensing aperture that can be rotated to align with either one of two apertures on a valve disc. Each aperture on the valve disc is in communication with a select one of the reservoirs allowing either of two, segregated liquids to be fed through a single nipple.

U.S. Pat. No. 6,237,800 issued to Barrett discloses a dual purpose water bottle that allows both a pet and a human to drink therefrom.

U.S. Pat. No. 5,353,964 issued to Liu et al. discloses a nursing bottle assembly including an outer bottle with an inner bottle received therein. The assembly further includes a valve means for allowing flow from either of the bottles or a combination of the two.

U.S. Pat. No. 4,893,729 issued to Iggulden et al. discloses a mixing bottle. As indicated above, several dual chamber infant bottles exist in the prior art. However, the dual chamber bottles referenced above are designed to allow dispensing of either of two segregated liquids through a single nipple. None of the above referenced patents include means for segregating contaminated from fresh infant formula or milk. The present invention solves this problem by providing a dual chamber infant bottle that allows a user to selectively deliver fresh milk or formula from a storage reservoir to a feeding reservoir thereby preventing saliva from contaminating formula within the storage reservoir.

SUMMARY OF THE INVENTION

The present invention relates to a dual chamber infant bottle comprising an upper feeding reservoir and a lower storage reservoir. The feeding reservoir includes an upper end with a dispensing opening thereon having a conventional nipple and sealing nut coupled therewith. The lower end of the reservoir includes a base portion having a fluid conduit formed therein that is in communication with the reservoir interior. The base portion includes an internally threaded collar for threadedly engaging a valve assembly. The valve assembly includes a substantially hollow housing having an upper end and a lower end. An externally threaded neck is disposed on the upper end of the housing for coupling with the internally threaded collar on the feeding reservoir base portion. The upper end also includes a fill aperture positioned thereon. Disposed within the valve assembly housing is a spring-biased rotatable disk likewise having a fluid channel therein. A lever extends from a side of the disk and slides within a slot on the valve assembly housing. Sliding the lever within the slot rotates the disk against the bias of the spring whereby the channel aligns with the fill aperture on the upper end of the valve assembly housing.

The storage reservoir includes a hollow container having an externally threaded neck on the upper end thereof that couples with an internally threaded portion on the valve assembly housing. By inverting the bottle and sliding the lever, a user can deliver a desired amount of formula or milk from the storage reservoir to the feeding reservoir. Accordingly, any milk or formula remaining in the storage reservoir after feeding will not be contaminated by the infant's saliva and therefore can be refrigerated for a subsequent feeding.

It is therefore an object of the present invention to provide an infant bottle that prevents baby formula from being contaminated with saliva.

It is another object of the present invention to provide an infant bottle that minimizes waste of baby formula or milk.

Other objects, features, and advantages of the present invention will become readily apparent from the following detailed description of the preferred embodiment when considered with the attached drawings and the appended claims.

BRIEF DESCRIPTION OF THE DRAWINGS

FIG. 5 is a side view of the valve assembly.

FIG. 6 is a bottom view of the valve assembly with the rotatable disk in a closed position.

FIG. 7 is a bottom view of the valve assembly with the rotatable disk in an open, dispensing position.

FIG. 8 is a side, cross-sectional view of the rotatable disk.

DESCRIPTION OF THE PREFERRED EMBODIMENT

Figure 1:
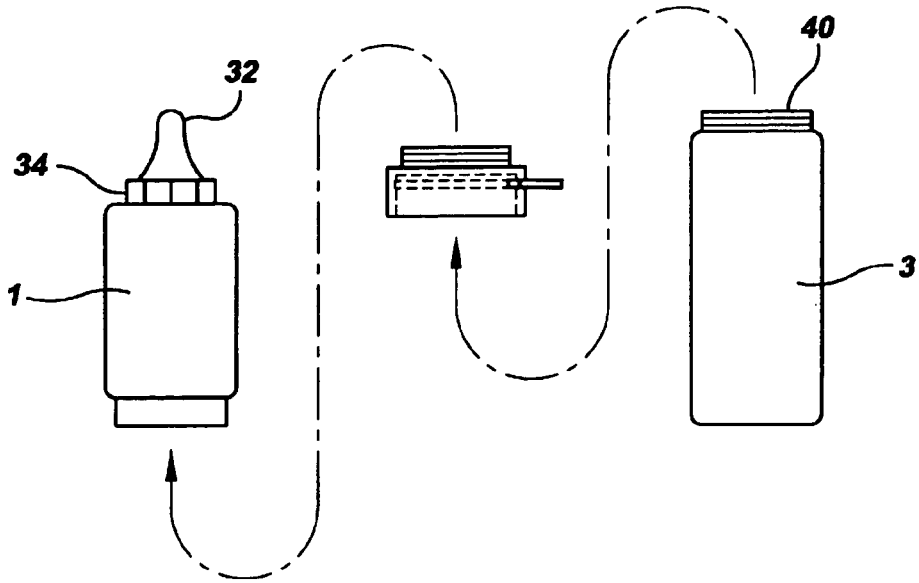
FIG. 1 is an exploded view of the infant bottle.
Figure 2:
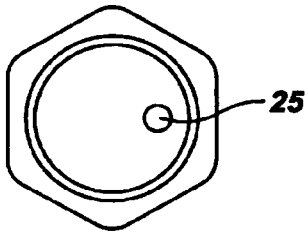
FIG. 2 is a bottom view of the feeding reservoir.
Figure 3:
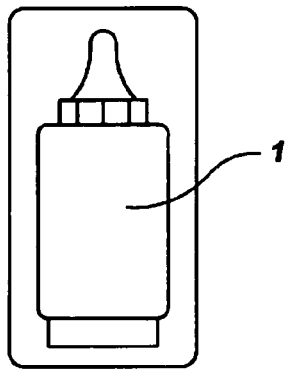
FIG. 3 is a side view of the feeding reservoir.
Figure 4:
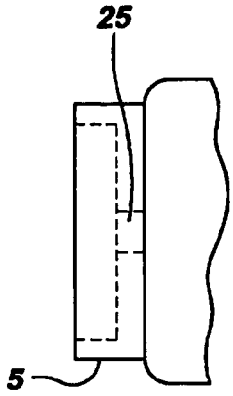
FIG. 4 is a sectional view of the feeding reservoir.

The present invention relates to a dual chamber infant bottle comprising an upper feeding reservoir 1 and a lower storage reservoir 3. The storage reservoir includes a hollow container having an externally threaded neck 40 on an upper end thereof that couples with an internally threaded portion on a valve assembly housing described in more detail, infra. The feeding reservoir includes an upper end with a dispensing throat having a conventional nipple 32 and sealing nut 34 coupled therewith. The lower end of the reservoir includes a base portion having a fluid passageway 25 formed therein and an internally threaded collar 5 for threadedly engaging a valve assembly 7.

The valve assembly includes a substantially hollow housing 2 having an upper end 4 with a fill aperture 22 thereon and a lower end 6. An externally threaded neck 8 is disposed on the upper end of the housing for coupling with the internally threaded collar on the feeding reservoir base portion. Disposed within the valve assembly housing is a spring-biased, rotatable disk 43 having a fluid channel 31. A rubber gasket 30 is disposed within the channel 31 for providing a liquid impermeable seal between the upper surface of the valve assembly housing and the disk. A lever 33 extends from the outer edge of the disk and is slidably received within a slot on a side of the valve assembly housing. By sliding the lever within the slot, the disk is rotated against the bias of the spring to a dispensing position so that the channel aligns with the fill aperture on the upper end of the valve housing.

By inverting the bottle and placing the lever in the dispensing position, a user can deliver a desired amount of formula or milk from the storage reservoir to the feeding reservoir. Accordingly, any milk or formula remaining in the feeding chamber after feeding can be discarded while that remaining in the storage reservoir will not be contaminated with saliva and therefore can be refrigerated for a subsequent feeding.

The present invention is not to be limited to the exact details of construction and enumeration of parts described above. For example, the storage reservoir could be specifically configured to accompany the device or alternatively, the feeding reservoir could be adapted to fit any conventional infant bottle allowing the infant bottle to function as the storage reservoir.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A dual chamber infant bottle comprising:

a storage reservoir;

a feeding reservoir attachable to said storage reservoir, said feeding reservoir having an upper end with a nipple positioned thereon, said nipple in fluid communication with said feeding reservoir;

a valve means positioned between said feeding reservoir and said storage reservoir for selectively establishing fluid communication between said storage reservoir and said feeding reservoir allowing delivery of a desired amount of fluid from said storage reservoir to said feeding reservoir, wherein said valve means includes a housing having an upper end with a fill aperture thereon, said housing further including means for coupling with both the feeding reservoir and the storage reservoir; a rotatable spring-biased disc received within said housing, said disc having a fluid channel formed therein; a lever attached to said disc and protruding from said housing whereby a user grasps said lever and rotates said disc until said channel aligns with the aperture on said housing upper end allowing fluid to flow from said storage reservoir to said feeding reservoir.

2. The bottle according to claim 1 wherein said feeding reservoir includes a lower end with a fluid passageway positioned therein, said lower end having a fastener means for coupling with said valve housing, said fluid passageway aligned with the fill aperture on the upper end of said valve housing.

3. The bottle according to claim 1 wherein said storage reservoir includes an upper end having a coupling means thereon for securing said storage reservoir to a lower end of said valve.

4. The bottle according to claim 3 further comprising a gasket positioned within said channel for providing a liquid impermeable seal between said disk and the upper end of said housing.

5. In combination with an infant bottle having an internal fluid storage reservoir and an open throat in communication therewith, an auxiliary assembly comprising:

a valve means attachable to said throat for allowing selective passage of fluid from said storage reservoir; wherein said valve assembly includes a housing having an upper end and a lower end, said lower end attachable to said bottle throat, said upper end having a dispensing aperture thereon, said upper end attachable to said feeding reservoir and a spring-biased, rotatable disc received within said housing, said disc having a channel formed therein whereby said disc is rotated against the bias of the spring until said channel aligns with the dispensing aperture to allow fluid to flow from the bottle, through the valve assembly housing and into a feeding reservoir;

the feeding reservoir attachable to said valve means for receiving and storing fluid from said storage reservoir thereby segregating said fluid within said feeding reservoir from fluid received within said storage reservoir so as to prevent cross contamination therebetween.

* * * * *